US005248107A

United States Patent [19]

Sumida et al.

[11] Patent Number: 5,248,107

[45] Date of Patent: Sep. 28, 1993

[54] WEB WINDER FOR WINDING UP WEB ON CORE AND METHOD OF AUTOMATICALLY WRAPPING LEADING END PORTION OF WEB AROUND CORE

[75] Inventors: Kunihiro Sumida; Shigehisa Shimizu; Hiroki Sato, all of Kanagawa, Japan

[73] Assignee: Fuji Photo Film Co., Ltd., Kanagawa, Japan

[21] Appl. No.: 845,612

[22] Filed: Mar. 4, 1992

[30] Foreign Application Priority Data

Mar. 5, 1991 [JP] Japan ..... 3-038584
Mar. 5, 1991 [JP] Japan ..... 3-038711

[51] Int. Cl.[5] ..... B65H 19/26
[52] U.S. Cl. ..... 242/56.6; 242/66
[58] Field of Search ..... 242/56.6, 56 R, 66, 242/56.2, 56.9

[56] References Cited

U.S. PATENT DOCUMENTS

| | | | |
|---|---|---|---|
| 3,030,042 | 4/1962 | De Gelleke | 242/66 X |
| 3,162,393 | 12/1964 | De Gelleke | 242/66 |
| 3,250,484 | 5/1966 | Fair | 242/66 |
| 3,346,209 | 10/1967 | Cronin | 242/66 |
| 3,514,047 | 5/1970 | DeMaille . | |
| 3,712,554 | 1/1973 | Lorenzini et al. | 242/56.9 X |
| 4,415,128 | 11/1983 | Heymanns | 242/66 |
| 4,438,888 | 3/1984 | Seelinger | 242/56.9 |
| 5,014,924 | 5/1991 | Nowisch et al. | 242/56 R |
| 5,161,747 | 11/1992 | Krämer | 242/56.9 |

FOREIGN PATENT DOCUMENTS

| | | |
|---|---|---|
| 2346330 | 3/1975 | Fed. Rep. of Germany . |
| 8601186 | 2/1986 | Fed. Rep. of Germany . |
| 9000513 | 1/1990 | Fed. Rep. of Germany . |
| 58-202238 | 11/1983 | Japan . |
| 62-83963 | 4/1987 | Japan . |
| 62-116448 | 5/1987 | Japan . |

*Primary Examiner*—Daniel M. Yasich
*Attorney, Agent, or Firm*—Sughrue, Mion, Zinn, Macpeak & Seas

[57] ABSTRACT

In a web winder for winding a web strip on a core, the web strip is brought into contact with the core at a predetermined position. The web strip is cut in such a position that the length of the portion of the web strip between the leading end and the predetermined position is slightly shorter than the length of the periphery of the core. The leading end portion of the web strip is applied to the circumferential surface of the core, and a wrapping roller is applied on the leading end portion of the web strip to press it against the core. Then the wrapping roller is rotated along the core toward said predetermined position by a predetermined angle with the web strip intervening between the core and the wrapping roller.

19 Claims, 12 Drawing Sheets

WEB WINDER FOR WINDING UP WEB ON CORE AND METHOD OF AUTOMATICALLY WRAPPING LEADING END PORTION OF WEB AROUND CORE

BACKGROUND OF THE INVENTION

1. Field of the Invention

This invention relates to a web winder for winding up web on a core and a method of and a system for automatically wrapping the leading end portion of the web around the core in the web winder.

2. Description of the Prior Art

When tuck is formed in the leading end portion of a rolled strip of paper, metal foil, fabrics or the like, the tucked portion can adversely affect equipment for handling the rolled strip, or the tucked portion must be wasted in the case where the tucked portion is unsuitable for use. Accordingly, in an web winder which slits wide web in a continuous length into a plurality of strips in a continuous length and winds up each strip on a core, there have been used a method of and a system for automatically wrapping the leading end portion of the strip around the core so that tuck is not formed in winding of the trailing portion of the web.

An example of such a system is disclosed in Japanese Unexamined Patent Publication No. 62(1987)-83963. The apparatus will be described with reference to FIG. 16, hereinbelow.

In FIG. 16, reference numerals 201 and 202 denote surface drums, reference numeral 204 denotes a rider roller and reference numeral 203 denotes a core. The core 203 is supported on the surface drums 201 and 202 and is driven by the drums 201 and 202 to wind thereon web 209. The web 209 is cut by a cutter 253 on a table 251 and then the leading end portion is folded along the core 203 by an air blower 252 prior to initiation of winding. Thereafter, a roller device 260 having a pair of small diameter rollers 259 moves toward the core 203 and presses the web 209 against the core 203. The roller device 260 is shown in FIG. 17.

If winding is initiated when the leading end portion is of excess length, the excess length portion forms tuck. In order to avoid formation of tuck, the web 209 is reversed by a length corresponding to the excess length by moving an adjustment roller 254 in the direction of the arrow in FIG. 16 and reversing the surface drums 201 and 202 so that the leading end of the web 209 stops immediately before a "roll-in position" in which the trailing portion of the web 209 begins to overlap the leading end portion.

The length by which the web 209 is reversed is measured by one of sensors S1, S2 and S3 which are disposed according to the diameter of the core 203 used. The roller device 260 brings the leading end portion of the web 209 into close contact with the surface of the core 203 so that the trailing end portion of the web 209 can overlap the leading end portion without formation of tuck when winding operation is initiated. When the surface drums 201 and 202 rotates in the regular direction in the winding operation and the leading end of the web 209 passes the roll-in position, the roller device 260 returns to the original position and the rider roller 204 is brought into contact with the web 209 to press the web 209 against the core 203. Thus the web 209 is wound on the core 203 with the core 203 held by the surface drums 201 and 202 and the rider roller 204.

In order to successfully wind the trailing portion on the leading end portion without formation of tuck, one of the small diameter rollers 259 nearer to the roll-in position than the other should be as near to the roll-in position as possible. For this purpose, the diameter of the nearer small diameter roller is as small as possible. At the same time, link mechanisms 261 and 262 for moving the small diameter rollers 259 are arranged to move the rollers 259 toward the core 203 while adjusting the orientation of the rollers according to the diameter of the core 203.

However the conventional system for automatically wrapping the leading end portion of the strip around the core is disadvantageous in that it takes a long time to reverse the surface drums 201 and 202 and to move the adjustment roller 205 in order to reverse the web 209.

The time required to reverse the web 209 adds to the total time required to produce a rolled web and decreases the productivity of the rolled web. This problem is especially serious when the lot size is small and the number of turns of each roll is small.

Further, the small diameter roller for wrapping the leading end of the web is apt to be deflected because it has a small diameter and a low rigidity, and accordingly the leading end portion of the web cannot be pressed against the core under uniform pressure. When the pressure fluctuates in the direction of width of the web, the leading end portion cannot be uniformly fed to the roll-in position, which can result in wrinkle and/or slack in the leading end portion of the rolled web obtained, and can cause a part of the side edge of the rolled web to project in the axial direction of the roll.

Further, in a conventional surface winder, a core is held by a pair of long surface drums and a single rider roller which is substantially equal to the drums in length and is rotated by the drums with a plurality of web strips obtained by slitting wide web nipped between the drums and the rider roller, whereby the strips are wound up on the core.

Generally, the thickness of the web fluctuates in the direction of width of the web. For example, the thickness of the web can fluctuate by several μm per 100 mm in the direction of width. When such web is slitted into strips and the strips are wound up at one time by the winder, the roll diameter differs from strip to strip due to the difference in thickness.

The difference in the roll diameter causes difference in pressure imparted to the strips by the surface drums and the rider roller, which causes the winding tightness to differ from strip to strip. When the winding tightness is excessive, the strip can be wrinkled and, in the case where the web is sensitized paper, the quality of the paper can be diminished. When the winding tightness is poor, the rolled strip can slack.

Further the difference in the roll diameter causes difference in surface speed, which can cause slip between part of the strips and the rider roller, and can result in scratch on the strips.

SUMMARY OF THE INVENTION

In view of the foregoing observations and description, the primary object of the present invention is to provide a web winder for winding up web on a core in which the web can be wound up on the core without formation of tuck and without increasing the winding time.

Another object of the present invention is to provide a web winder in which all the web strips can be wound with the same winding tightness even if the thickness differs from strip to strip.

Still another object of the present invention is to provide a method of and a system for wrapping the leading end portion of the web around the core without formation of tuck and without increasing the winding time.

In accordance with a first aspect of the present invention, there is provided a web winder comprising a slitting means which slits wide web in a continuous length into a plurality of web strips, a cutting means for cutting the web strips, a wrapping means which wraps the leading end portion of each web strip around a core, a driving means which rotates the core, and a rider roller which presses each web strip against the core, characterized in that said wrapping means comprises a contacting means which brings each web strip into contact with the core at a predetermined position, an applying means which applies the leading end portion of the web strip to the circumferential surface of the core and a wrapping roller which presses the leading end portion of the web strip against the core and rotates along the core toward said predetermined position by a predetermined angle with the web strip intervening between the core and the wrapping roller, and said cutting means cuts the web strip in such a position that the length of the portion of the web strip between the leading end and said predetermined position is slightly shorter than the length of the periphery of the core.

In accordance with a second aspect of the present invention, there is provided a method of wrapping the leading end portion of the web strip around the core comprising the steps of bringing each web strip into contact with the core at a predetermined position, cutting the web strip in such a position that the length of the portion of the web strip between the leading end and said predetermined position is slightly shorter than the length of the periphery of the core, applying the leading end portion of the web strip to the circumferential surface of the core, applying a wrapping roller on the leading end portion of the web strip to press it against the core, and rotating the wrapping roller along the core toward said predetermined position by a predetermined angle with the web strip intervening between the core and the wrapping roller.

In accordance with the apparatus and the method of the first and second aspects of the present invention, since the web strips need not be reversed, the web strips can be wound up without formation of tuck and without elongating the overall winding time. Further, since the wrapping roller need not have a small diameter, the pressure imparted to each web strip can be uniform in the direction of width of the web strip, whereby the web strip can be wound without causing wrinkle or slack in the leading end portion of the rolled web and without causing a part of the side edge of the rolled web to project in the axial direction of the roll.

In accordance with a third aspect of the present invention, there is provided a winder comprising a slitting means which slits wide web in a continuous length into a plurality of web strips, a cutting means for cutting the web strips, a wrapping means which wraps the leading end portion of each web strip around a core, a driving means which rotates the core, and a rider roller which presses each web strip against the core, characterized in that said rider roller is divided into a plurality of divisional rider rollers in the direction of the width of the web and each of the divisional rider rollers is arranged to press one or more web strips separately from the other rider rollers.

In the apparatus in accordance with the third aspect of the present invention, the web pressing force of the divisional rider rollers can be adjusted according to the thickness of the corresponding web strip(s) separately from each other. Thus, the winding tightness can be held uniform even if difference in the roll diameter is produced due the difference in thickness of the web strips, whereby wrinkle or slack in the rolled web or deterioration of quality of the web due to fluctuation in the winding tightness can be prevented.

Though it is preferred that one divisional rider roller be provided per web strip, it is possible to arrange so that one divisional rider roller presses two or more web strips against the core.

In one preferred embodiment, each divisional rider roller is rotated by a driving means and has a torque limiting means which limits the torque transmitted to the divisional rider roller from the driving means.

With this arrangement, the torques transmitted to the divisional rider rollers can be uniform and the rotational speed of each divisional rider roller relative to the web strip can be limited within a predetermined range, whereby possibility of scratching the web strips can be minimized.

DESCRIPTION OF THE PREFERRED EMBODIMENT

Figure 1:
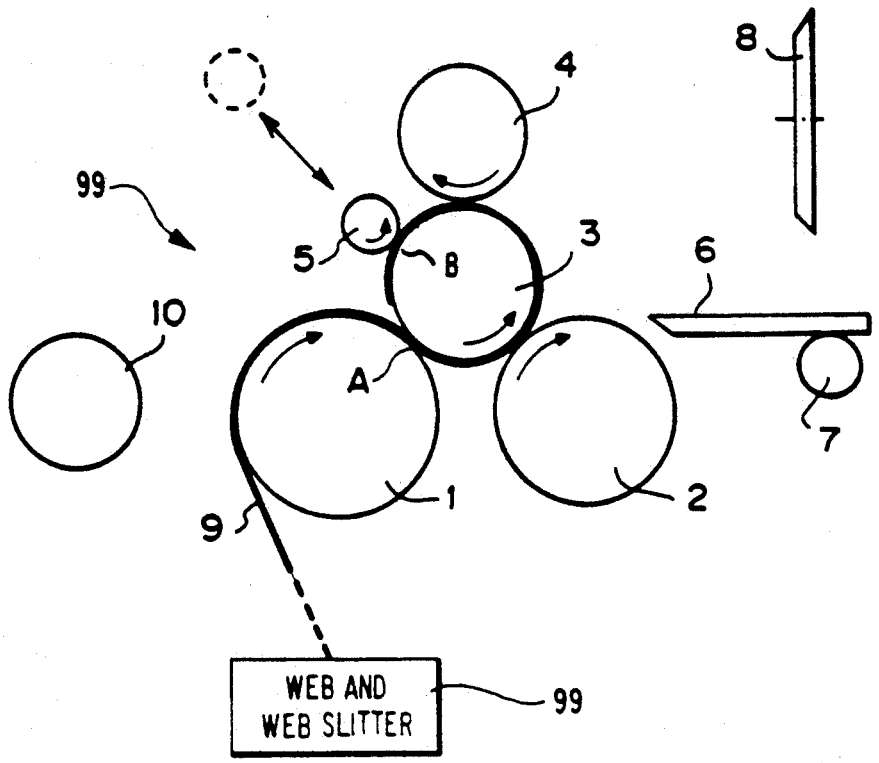
FIG. 1 is a schematic side view showing a part of a winder in accordance with an embodiment of the present invention.

FIG. 1 schematically shows a wrapping system in accordance with an embodiment of the present invention which is incorporated in a winder 99 which slits wide web via slitting means 98 into a plurality of web strips and winds the web strips on a core.

In FIG. 1, reference numerals 1 and 2 denote a pair of surface drums, and a core 3 is supported on the surface drums 1 and 2 and held thereon by a rider roller 4. Here, surface drum 1 acts as a contacting means bringing web strips 9 into contact with core 3 at point A.

A wrapping table 6 is provided on one side of the surface drums 1 and 2 and web strips 9 in continuous lengths are cut on the wrapping table 6 by a cutter 8. The cutter 8 is a score cut traveling cutter having a rotary circular blade and is driven up and down by a driving mechanism (not shown). The wrapping table 6 serves also as a transfer table for transferring rolled webs.

Though not shown, a guide rail which supports a slide roller 7 and guides it in the transverse direction is provided below the wrapping table 6. The wrapping table 6 is movable up and down together with the slide roller 7, and the slide roller 7 is movable in the transverse direction toward and away from the core 3 in an upper position. Slide roller 7 acts as an applying means by lifting the leading end portion of the web strips 9 and pressing the leading end portion against the core 3. The function and operation of slide roller 7 will be more fully described below.

A wrapping roller 5 is movable in a radial direction of the core 3 between a retracted position away from the core 3 and a wrapping position in which it presses the web strips 9 against the core 3. The retracted position of the wrapping roller 5 is shown by the broken-line circle in FIG. 1. In the wrapping position, shown by the solid-line circle; the wrapping roller 5 is movable along the circumferential surface of the core 3 by a predetermined angle between the wrapping start position and the wrapping ending position. The wrapping ending position is a position on the core immediately before the roll-in position (the rear end of the portion of the web strip 9 which is in contact with the core 3, indicated as point A), where the trailing portion of each web strip 9 begins to overlap the leading end portion. The position shown by the solid-line circle is at the wrapping start position indicated as point B. A nip roller 10 for holding stationary the web strips 9 during preparation for winding is provided on the outer side of the surface drum 1 to be movable between a retracted position away from the surface drum 1 and a holding position in which it presses the web strips 9 against the surface drum 1 to hold the web strips stationary.

Figure 2:
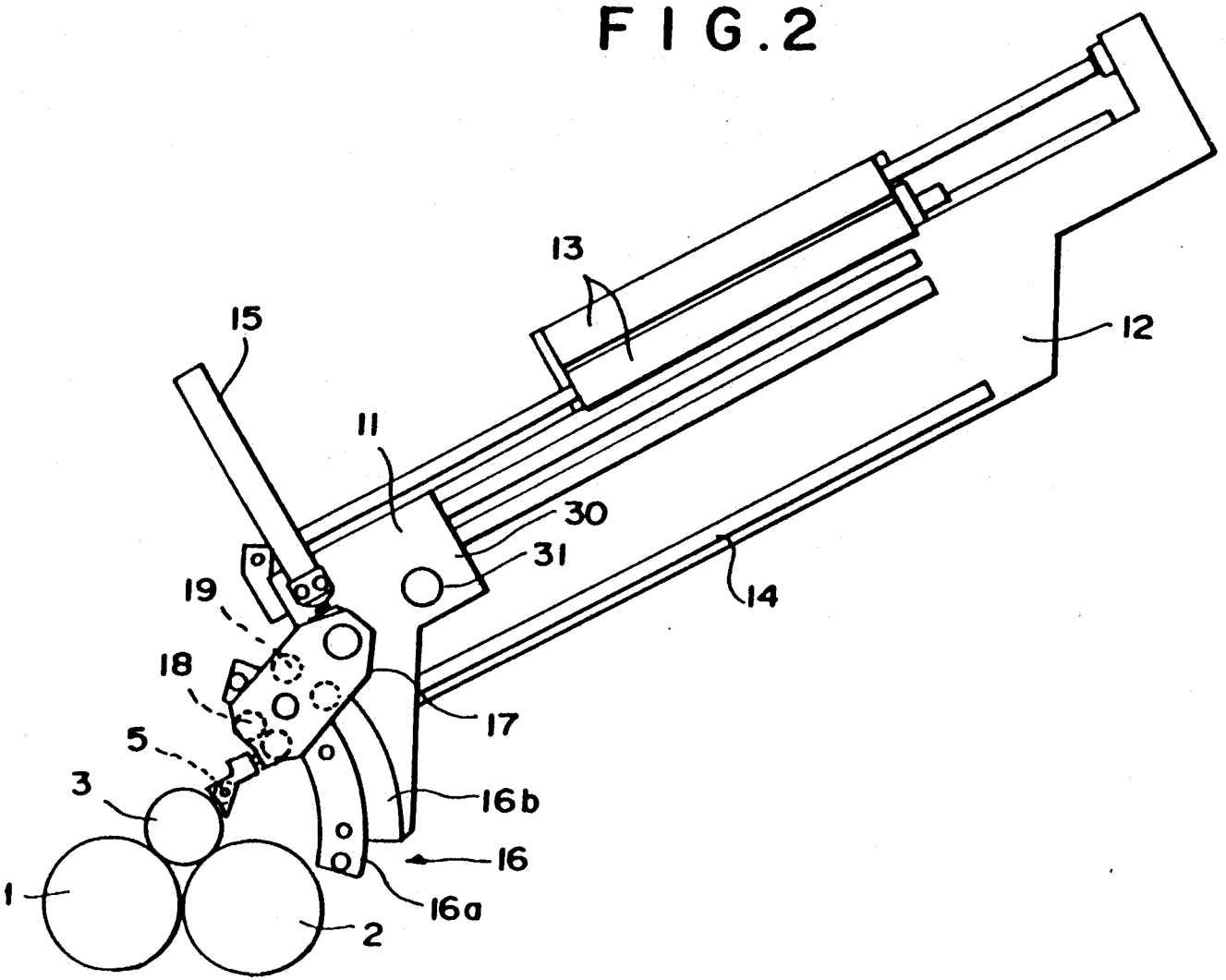
FIG. 2 is a side view showing the wrapping roller.

As shown in FIG. 2, which is a side view as seen from the side opposite to the side in FIG. 1, the wrapping roller 5 is supported for rotation on a slider 11, which forms a movable frame and is mounted on a stationary frame 12 to be movable relative to the stationary frame 12.

A pair of cylinder devices 13 and a linear slide guide 14 which form a moving means are mounted on the stationary frame 12. The slider 11 is driven back and forth along the linear slide guide 14 by the rods of the cylinder devices 12 and 13 and moves the wrapping roller 5 between the retracted position and the wrapping position. The position of the slider 11 can be adjusted by means of a rack 30 and a pinion 31 to conform to the diameter of the core 3 and the thickness of the web strips 9.

A rotating means comprising a rotating cylinder device 15 and an arcuate slide guide 16 is provided on the slider 11. The arcuate slide guide 16 has a diametrical guide portion **16*a* and an axial guide portion 16*b* each of which is in the form of an arcuate wide rail. When the slider 11 is in the position shown in FIG. 2 where it holds the wrapping roller 5 in the wrapping position, the centers of the arcs of the guide portions 16*a* and 16*b* are on the axis of the core 3**.

A wrapping roller support portion 17 has first and second pairs of guide rollers 18 and 19. The first pair of guide rollers 18 are disposed on the inner side of the diametrical guide portion **16*a* and the second pair of guide roller 19 are disposed on the outer side of the diametrical guide portion 16*a*. The rod of the rotating cylinder device 15 is connected to the rear end of the wrapping roller support portion 17. The wrapping roller support portion 17 is driven by the cylinder device 15 to move in a radial direction under the guidance of the guide rollers 18 and 19 and the diametrical guide portion 16*a*, and in an axial direction under the guidance of the second pair of guide rollers 19 and the axial guide portion 16*b***.

Figure 3:
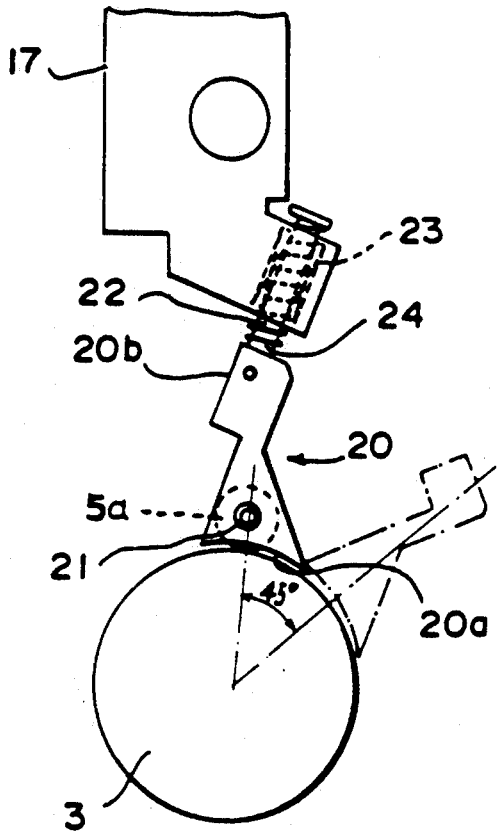
FIG. 3 is an enlarged view of a part of FIG. 2, FIGS. 4 to 11 are side views of the major elements of the winder in different steps.

Turning to FIG. 3, the wrapping roller 5 comprises a plurality of divisional wrapping rollers **5*a* which are aligned with each other in the axial direction. Each divisional wrapping roller 5*a* wraps one of the web strips 9. Each divisional wrapping rollers 5*a* is provided with a web guide 20 on each end thereof. The web guide 20 has a front end portion which is substantially triangular and is tapered toward the roll-in position as seen in the axial direction of the wrapping roller 5. The web guides 20 fixedly support a shaft 21 which supports the divisional wrapping roller 5*a* for rotation. The divisional wrapping roller 5*a* projects toward the web strip 9 beyond the front end of the web guides 20. The side 20*a* of the web guide 20 which is opposed to the core 3 is curved to form an arc the diameter of which is substantially equal to the outer diameter of the core 3**.

The web guide 20 is fixedly connected to a pin 22 at its rear end portion **20*b*. The pin 22 is supported in a through hole 23 formed in the wrapping roller support portion 17 and is slightly slidable in its axial direction. A spring 24 for urging the divisional wrapping rollers 5*a* toward the core 3 is fit on the pin 22 and one end of the spring 24 is engaged with a shoulder formed in the through hole 23**.

FIGS. 4 to 11 are side views of the major elements of the winder 99 in different steps. In FIGS. 4 to 11, the web guides 20 are removed.

Figure 4:
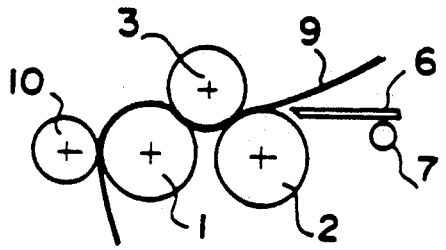

FIG. 4 shows the state prior to the initiation of winding. The wrapping table 6 and the slider roller 7 are in the lower position. The nip roller 10 is in the holding position and holds the web strips 9 stationary. The web strips 9 have been cut by the cutter 8 (omitted in FIGS. 4 to 11) from the rolled webs which were wound up in the preceding winding operation. The cutter 8 is arranged to cut the web strips 9 on the wrapping table 6 in a position where the leading end or the cut end of the web strips 9 just reaches the wrapping ending position when the leading and portions are wrapped around the core 3, as shown in FIG. 1. That is, the length between the leading end and the roll-in position is substantially equal to the length of the periphery of the core 3.

Figure 5:
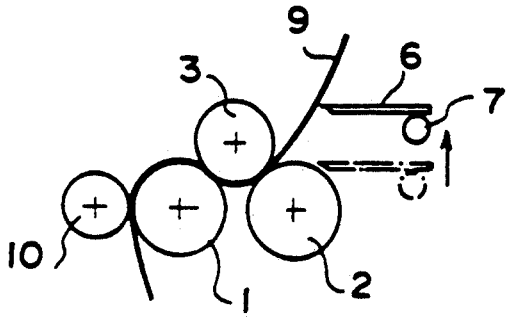

Then the wrapping table 6 and the slide roller 7 are moved upward and the leading end portion of each web strip 9 is lifted by the end of the wrapping table 6 as shown in FIG. 5.

Figure 6:
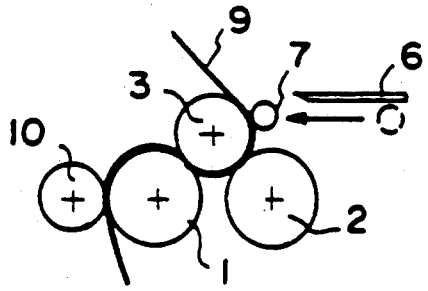

Thereafter, the slide roller 7 moves toward the core in the horizontal direction and presses the web strips 9 against the core 3. In this state, the leading end of each web strip 9 projects upward and is turned over the core 3 as shown in FIG. 6.

Figure 7:
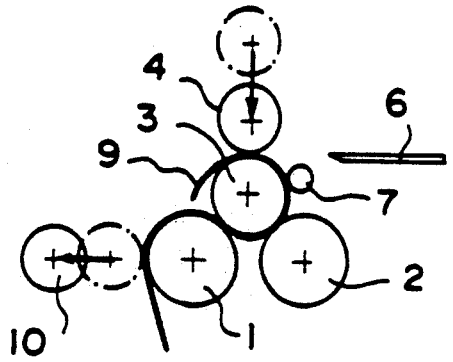

The rider roller 4 subsequently moves downward while rotating and presses the projecting end portions of the web strips 9 against the core 3, whereby the leading end portion of each web strip 9 is curved downward as shown in FIG. 7. Then the nip roller 10 moves away from the surface drum 1 to the retracted position.

Figure 8:
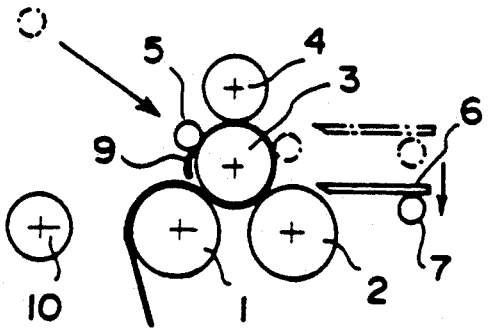

The wrapping roller 5 which has been in the retracted position on the side of the core 3 opposite to the wrapping table 6 is moved toward the core 3 at about 45° to the horizontal carried by the slider 11 and is positioned in the wrapping start position as shown in FIG. 8. The wrapping table 6 and the slide roller 7 return to their original positions.

Figure 9:
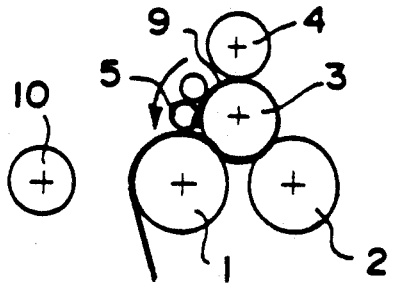

Thereafter, the wrapping roller 5 is rolled on the circumferential surface of the core 3 by about 45° to the wrapping ending position by the rotating means, and wraps the leading end portion of each web strip 9 around the core 3 in close contact therewith as shown in FIG. 9. The wrapping roller 5 is arranged to easily rotate about its axis when it is moved from the wrapping start position to the wrapping ending position.

Figure 10:
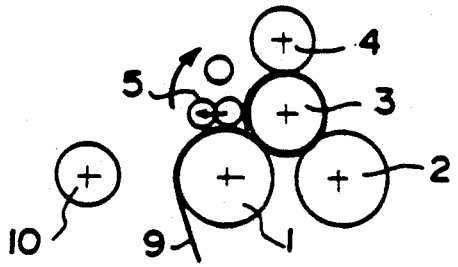

After the leading portions of the web strips 9 are thus wrapped around the core 3, the surface drums 1 and 2 and the rider roller 4 start rotating, and the core 3 starts rotating driven by the surface drums 1 and 2 and the rider roller 4, that is, the winder 99 provided with the wrapping system starts winding. When the leading end of each web strip 9 is moved, for instance, by 10 cm and passes the roll-in position, the wrapping roller 5 is slightly moved away from the web strip 9 and then returns to the angular position in the wrapping start position as shown in FIG. 10.

Figure 11:
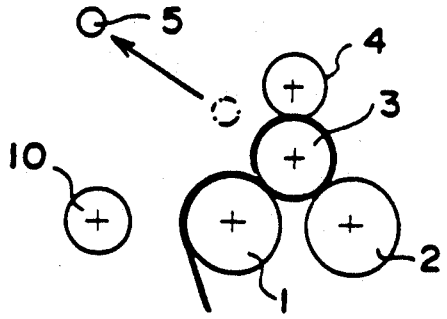

As the winding operation continues, the slider 11 returns the wrapping roller 5 to the retracted position as shown in FIG. 11.

The wrapping system of this embodiment is advantageous over the conventional system in the following points.

Since the web strips need not be reversed, the web strips can be wound up without formation of tuck and without elongating the overall winding time.

The wrapping roller need not have a small diameter, and accordingly, the pressure imparted to each web strip can be uniform in the direction of width of the web strip, whereby the web strip can be wound without causing wrinkle or slack in the leading end portion of the rolled web and without causing a part of the side edge of the rolled web to project in the axial direction of the roll. Further since the wrapping roller 5 comprises a plurality of divisional wrapping rollers 5*a*, each web strip 9 can be wrapped around the core in an optimal manner even if the thickness and width of the web strip 9 fluctuates from strip to strip and the diameter of the core 3 fluctuates in the axial direction.

By virtue of the web guide 20 which is tapered toward the roll-in position, the leading end of each web strip 9 can be guided to a position extremely near to the roll-in position and can approach the roll-in position at a small angle, whereby the leading end portion can smoothly get in under the trailing portion.

The action of the wrapping roller 5 need not be changed according to the thickness of the web strip 9, the diameter of the core 3 or the like, unlike in the conventional wrapping system where the orientation of the small diameter rollers must be changed according to the diameter of the core 3. Thus in the wrapping system of this embodiment, neither a mechanism nor a time for changing the action of the wrapping roller is required.

The wrapping system of this embodiment can be variously modified. For example, instead of forming the wrapping roller 5 by a plurality of divisional wrapping rollers 5*a* in order to make the pressing force on each of the respective web strips uniform even if the thickness of the web strip differs from strip to strip, the wrapping roller 5 may be in the form of a single roller made of elastic material such as rubber. Further a cushion roller may be employed in place of the slide roller 7. Further, the leading end portion of the web strip 9 may be turned over the core 3 by air blow in place of the slide roller 7. Each divisional wrapping roller 5*a* may be urged toward the core 3 by a cylinder device in place of the spring 24.

The wrapping system of this embodiment may be also applied to a winding mechanism for a coater, laminator, printer or the like.

Figure 12:
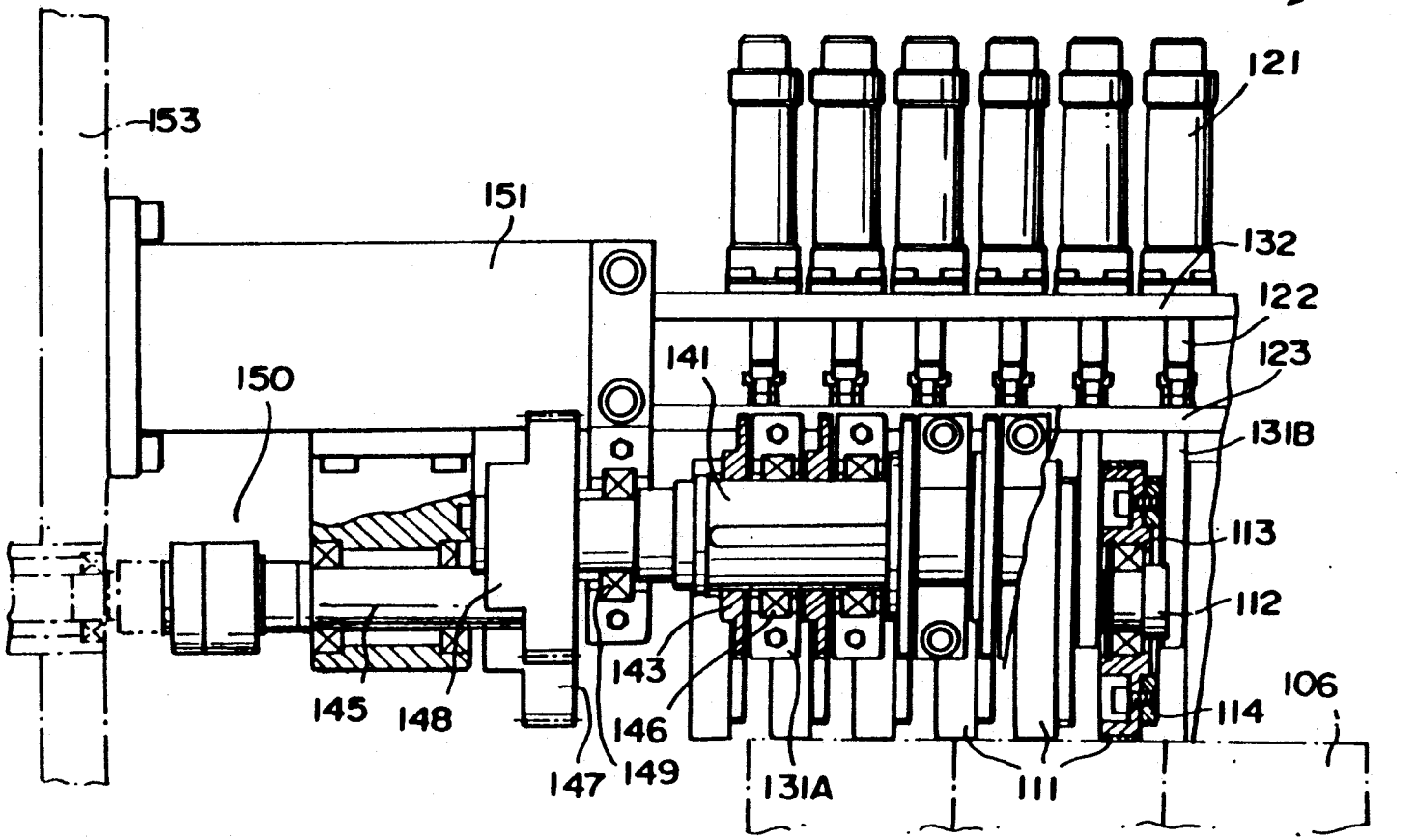
FIG. 12 is a fragmentary front view showing a winder in accordance with another embodiment of the present invention.
Figure 13:
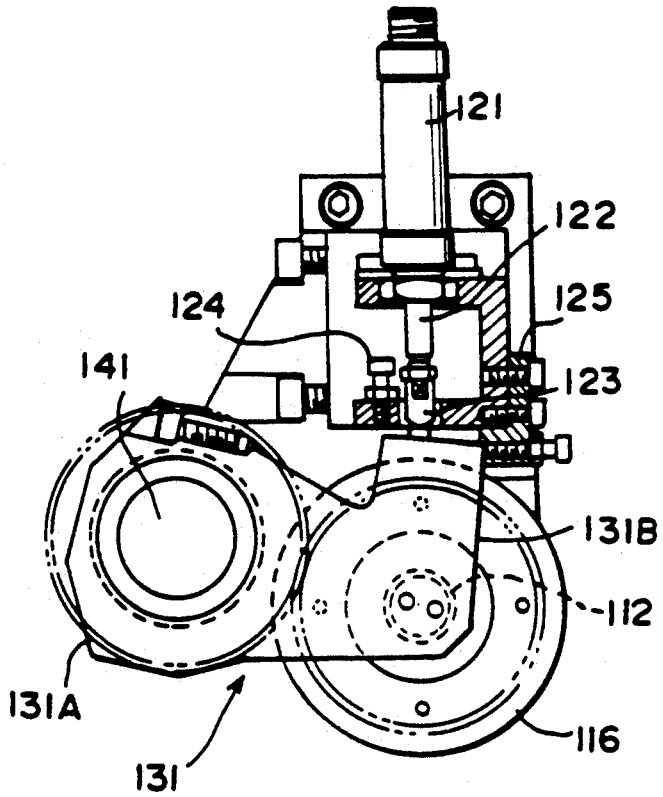
FIG. 13 is a fragmentary cross-sectional view of the apparatus.
Figure 14:
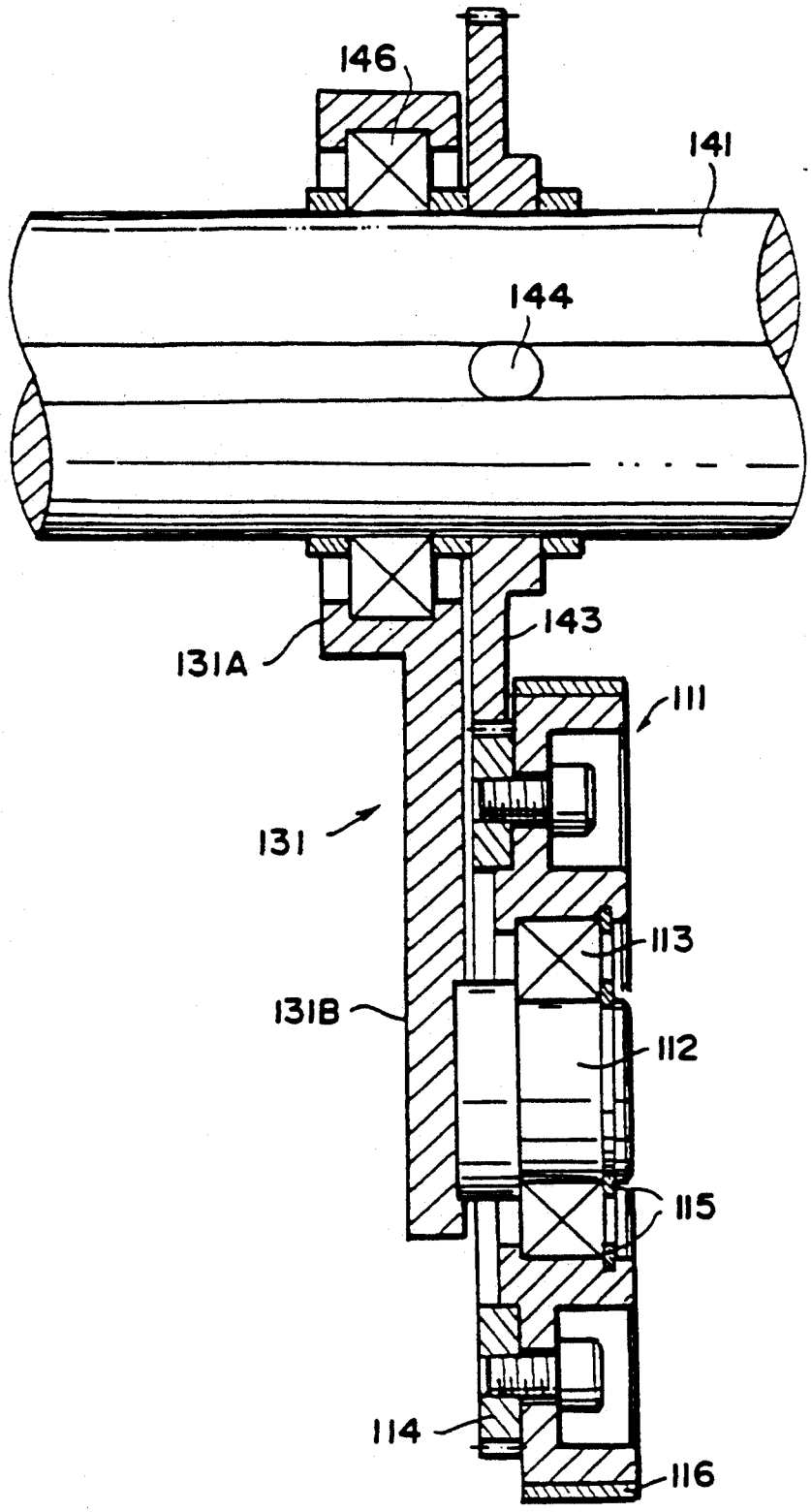
FIG. 14 is a fragmentary cross-sectional view of a part of the apparatus.

FIGS. 12 to 14 show a wind-up device in accordance with another embodiment of the present invention. FIGS. 12 to 14 mainly show the structure of the rider roller which is the main feature of this embodiment.

In FIGS. 12 and 13, web 106 in a continuous length is slitted into a plurality of web strips and the web strips are wound around core while each of the web strips is pressed against the core by one of divisional rider rollers 111 of a rider roller 100 which have the same axial lengths and are arranged in alignment with each other at regular intervals.

Each divisional rider roller 111 is supported by a corresponding swing arm 131 by way of a divisional roller shaft 112 and a roller bearing 113. An annular rubber member 116 is fit on the divisional rider roller 111 in order to obtain a proper friction when the divisional rider roller 111 presses the web strip against the core.

Each swing arm 131 comprises a hollow portion 131A which is supported by a driving shaft 141 for the divisional rider roller 111 to be rotatable about the shaft 141, and a support plate portion 131B which is formed integrally with the hollow portion 131A. The support plate portion 131B supports the divisional rider roller 111 for rotation, and is urged toward the core by a spherical member 123 which is supported on a rod 122 of an air cylinder device 121. Rotation of the support plate portion 131B in opposite directions is limited by stoppers 124 and 125.

The air cylinder device 121 is mounted on a support plate 132 by bolts and the support plate 132 is mounted on a movable frame 153 by way of a bracket 151. The movable frame 153 is driven by a moving means not shown and linearly moves the rider roller 100 in the direction perpendicular to the axial direction of the driving shaft 141 between an operative position in which the rider roller 100 presses the web strips against the core and a retracted position in which it is away from the web strips.

Each driving shaft 141 supports a roller driving gear 143 to be rotated integrally therewith. Each roller driving gear 143 is in mesh with a driven gear 114 on each divisional rider roller 111 to drive it.

As shown in FIG. 12, one end of the driving shaft 141 is supported for rotation on the bracket 151 by way of a bearing 149, and the other end of the driving shaft 141 is supported on a shaft support portion (not shown) which is fixed to an end portion of the support plate 132.

Said one end of the driving shaft 141 is connected to one end of a transmission shaft 145 by way of gears 147 and 148 which are in mesh with each other. The other end of the transmission shaft 145 is connected to a driving mechanism (not shown) by way of a coupling 150.

FIG. 14 is a cross-sectional view showing one of the divisional rider rollers 111. The roller driving gear 143 is supported on the driving shaft 141 by way of a key 144 to be rotated integrally therewith. The hollow portion 131A of the swing arm 131 by way of a bearing 146 is rotatable relative thereto. The swing arm 131 fixedly supports the divisional roller shaft 112 at the support plate portion 131B and the divisional roller shaft 112 supports the divisional rider roller 111 for rotation by way of the bearing 113. The driven gear 114 is bolted to the side of the divisional rider roller 111 and is in mesh with the driving gear 143 to be rotated thereby.

When the web strips are wound, the air pressure in the air cylinder devices 121 are held constant. Since each divisional rider roller 111 can be rotated about the driving shaft 141 in response to counterforce from the corresponding web strip during winding, each divisional rider roller 111 presses the corresponding web strip by the pressure of the corresponding air cylinder device 121. Accordingly, the rider roller 100 can press all the web strips with substantially the same pressing force even if the web strips have different thicknesses and the winding diameter differs from strip to strip, whereby the winding tightness can be uniform.

When the air pressures in the respective air cylinder devices 121 are separately controlled, the winding tightness can be controlled for each web strip. For example, it is possible to increase the winding tightness of the web strip(s) in a particular position.

All the divisional rider rollers 111 are rotated at the same speeds by way of the respective driving gears 143 and the driven gears 114.

Since rotation of the support plate portion 131B of each swing arm 131 in opposite directions is limited by the stoppers 124 and 125, and the rotational angles of the swing arms 131 are limited in a predetermined range, the positions of the respective divisional rider rollers 111 cannot greatly differ from each other even if the rider roller 100 is moved to the retracted position away from the web strips and the respective divisional rider rollers 111 are released from the web strips. Accordingly, the rider roller 100 can perform subsequent operation without any trouble.

Since each swing arm 131 rotates about the axis of the driving shafts 141, the distance between the axis of the driving shaft 141 and the axis of each divisional rider roller 111 is constant irrespective of the angular position of the divisional rider roller 111 relative to the driving shaft 141. Additionally the rotational speed of each divisional rider roller 111 can be kept constant irrespective of the angular position of the divisional rider roller 111 for the reason just stated.

Preferably, the number of the divisional rider rollers 111 is as large as possible, though depending on the total length of the rider roller 100, the length or thickness of each divisional rider roller 111, the thickness of the swing arms 131, the thickness of the gears 143 and 114, and the like. More preferably, at least one divisional rider roller 111 is provided for each web strip. For example, when the length of each divisional rider roller 111 is 16 mm, the divisional rider rollers 111 can be at intervals of 32 mm. In this case, the web strips spaced from each other by at least 32 mm can be wound in an optimal manner.

Figure 15:
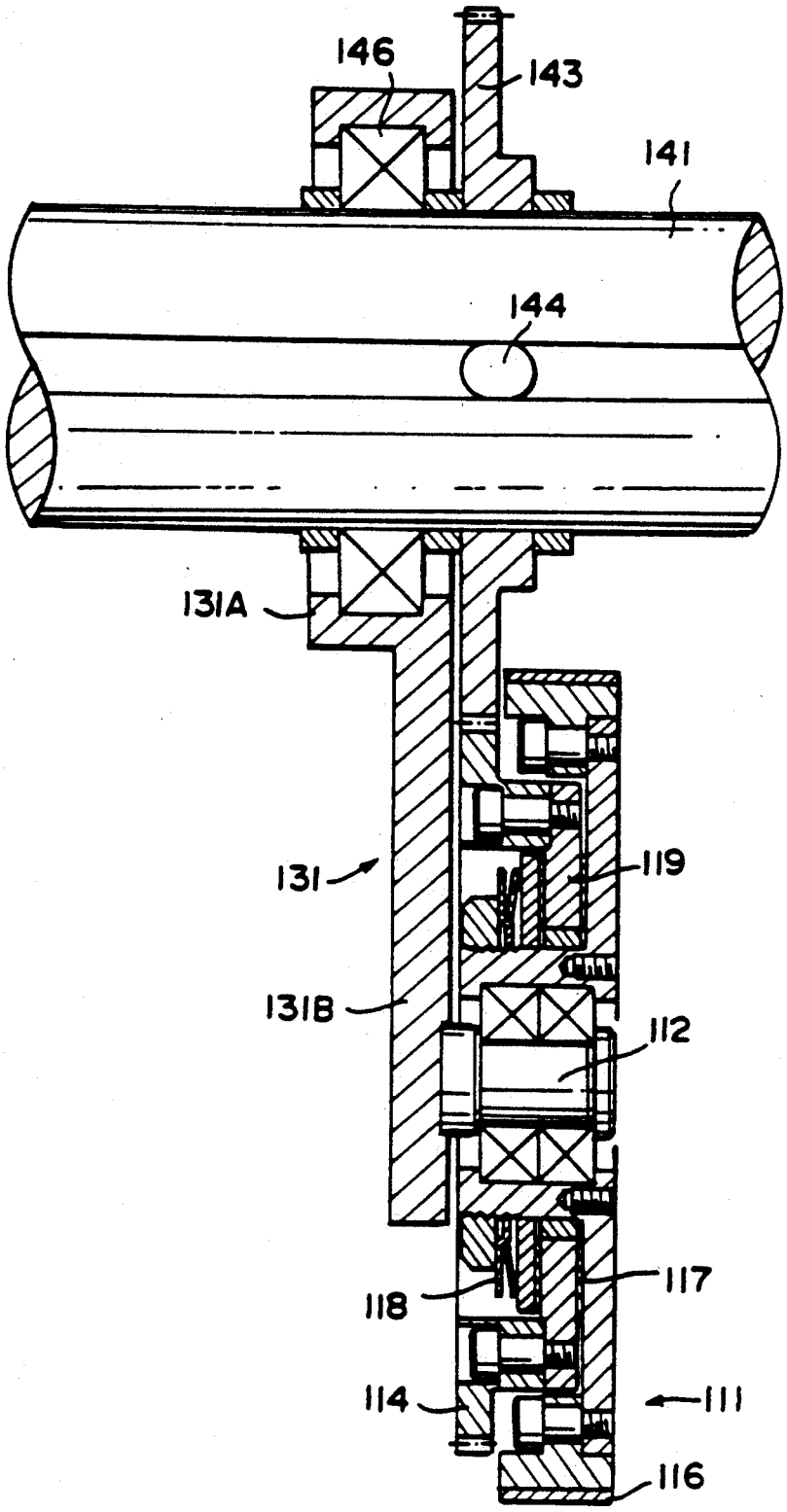
FIG. 15 is a view similar to FIG. 14 but showing a modification.
Figure 16:
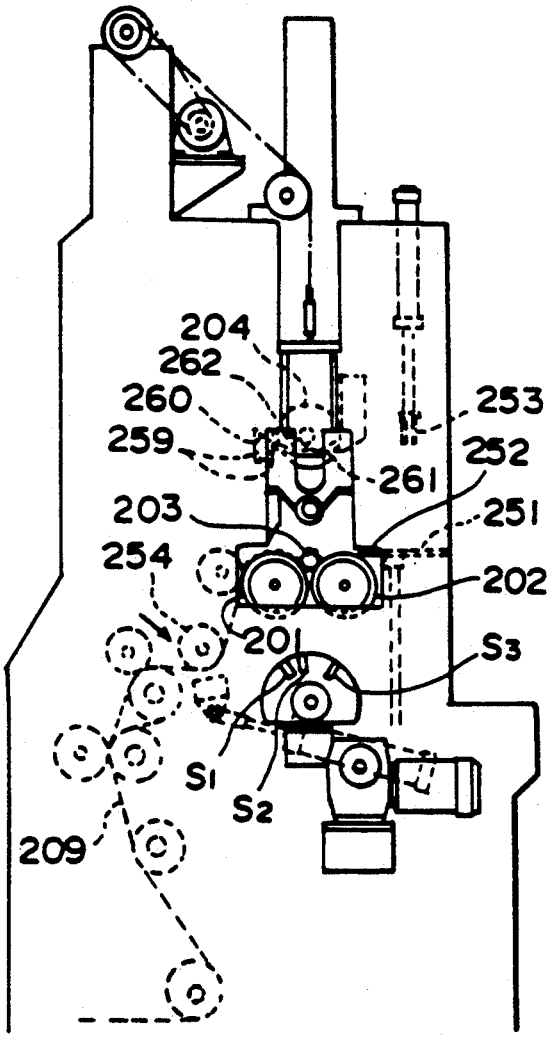
FIG. 16 PRIOR ART
FIG. 16 is a schematic view showing a conventional winder.
Figure 17:
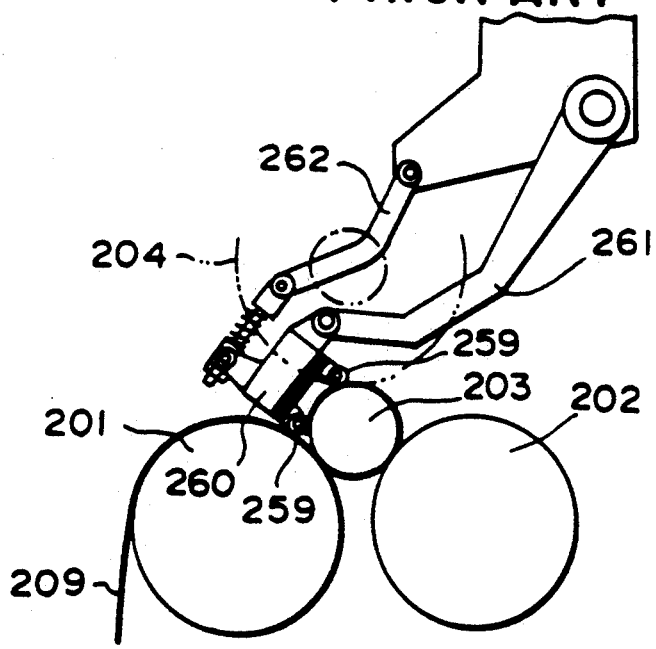
FIG. 17 PRIOR ART
FIG. 17 is a fragmentary view showing a part of the conventional apparatus.

In a modification shown in FIG. 15, each divisional rider roller 111 is connected to the driven gear 114 by way of a sliding member 117 and a plate spring 118 which presses the sliding member 117 against a rotary plate 119 fixed to the driven gear 114, whereby the driving torque transmitted to the divisional rider roller 111 is limited in a predetermined range. In this case, unlike in the preceding embodiment where the rotational speeds of the respective divisional rider roller 111 are equal to each other, the winding tightness is held constant by transmitting the same driving torque to each of the divisional rider rollers 111. In this modification, the winding tightness can be controlled better than in the embodiment described above.

The divisional rider rollers 111 need not be the same in length. For example, a long divisional rider roller may be provided for a plurality of web strips whose difference in thickness is relatively small while one divisional rider roller is provided for each of the web strips whose difference in thickness is relatively large. For example, in the case of paper web, difference in thickness is large in opposite edge portions and is relatively small in the middle. In such a case, one divisional rider roller may be provided for each of the web strips slit from opposite edge portions of the web and a long divisional rider roller may be provided for a plurality of web strips slit from the middle portion of the web.

Instead of supporting each divisional rider roller 111 by the swing arms 131 in order to make the pressing force on each of the web strips uniform, each divisional rider roller 111 may be supported by a slider member which is guided by a linear guide and is driven by a cylinder device. Further, though each divisional rider roller 111 is driven by way of the gears 143 and 114 in the embodiment described above, it may be driven by way of pulleys and a belt.

Each divisional rider roller 111 may be pressed against the core under the force of a spring of gravity or by a hydraulic cylinder device in place of the air cylinder employed in the embodiment described above.

A surface-treated metal member may be fitted on each divisional rider roller 111 in place of the rubber member, or a grooved roller or a matted roller may be employed as the divisional rider roller 111.

The present invention can be applied to various winder such as center winding winder without being limited to the double drum surface winder.

What is claimed is:

1. A web winder comprising a slitting means which slits a wide web in a continuous length into a plurality of web strips, a cutting means for cutting the web strips, a wrapping means which wraps a leading end portion of each of said web strips around a core, a driving means which rotates the core, and a rider roller which presses each of said web strips against the core, said wrapping means comprises a contacting means which brings each of said web strips into contact with the core at a predetermined position, an applying means which applies the leading end portion of each of said web strips to a circumferential surface of the core, and a warpping roller which presses the leading end portion of each of said web strips against the core and rotates along the core toward said predetermined position by a predetermined angle with the web strips intervening between the core and the wrapping roller, and wherein said cutting means cuts each of said web strips in such a position that a length of a portion of each of said web strips between a leading end of each of said web strips and said predetermined position is slightly shorter than a length of said circumferential surface of the core.

2. A web winder as defined in claim 1 in which said wrapping roller comprises a plurality of divisional wrapping rollers which are arranged in a row in a direction of the width of said wide web.

3. A web winder as defined in claim 1 in which said wrapping roller is provided with a web guide having a guide surface which is positioned close to the circumferential surface of the core when the wrapping roller is pressing the leading end portion of each of said web strips against the core.

4. A web winder as defined in claim 3 in which said guide surface of the web guide is an arcuate surface whose radius of curvature substantially conforms to a radius of curvature of the core.

5. A web winder as defined in claim 4 in which said web guide is tapered toward said predetermined position in cross-section.

6. A web winder as defined in claim 1 in which said contacting means comprises a surface drum on which the core is positioned.

7. A web winder as defined in claim 6 in which said applying means comprises a slide roller which is movable up and down and toward and away from the core, and lifts the leading end portion of each of said web strips and presses it against the core.

8. A web winder as defined in claim 1 in which said rider roller is divided into a plurality of divisional rider rollers in a direction of the width of said wide web and each of the divisional rider rollers is arranged to press one or more of said web strips separately from the other divisional rider rollers.

9. A winder comprising a slitting means which slits a wide web in a continuous length into a plurality of web strips, a cutting means for cutting each of said web strips, a wrapping means which wraps a leading end portion of each of said web strips around a core, a driving means which rotates the core, and a rider roller which presses each of said web strips against the core, wherein said rider roller is divided into a plurality of divisional rider rollers in a direction of the width of said wide web and each of the divisional rider rollers is arranged to press one or more of said web strips separately from the other divisional rider rollers, wherein said wrapping means comprises a contacting means which brings each of said web strips into contact with the core at a predetermined position, an applying means which applies the leading end portion of each of said web strips to a circumferential surface of the core, and a wrapping roller which presses the leading end portion of each of said web strips against the core and rolls along the core toward said predetermined position by a predetermined angle with the web strips intervening between the core and the wrapping roller, and wherein said cutting means cuts each of said web strips in such a position that a length of a portion of each of said web strips between a leading end of each of said web strips and said predetermined position is slightly shorter than a length of said circumferential surface of the core.

10. A winder as defined in claim 9 in which one of said divisional rider rollers is provided for each of said web strips.

11. A winder as defined in claim 9 in which each of said divisional rider rollers is rotated by a driving means an has a torque limiting means which limits the torque transmitted to each of said divisional rider rollers from the driving means.

12. A method of wrapping a leading end portion of a web strip around a core comprising the steps of bringing the web strip into contact with the core at a predetermined position, cutting the web strip in such a position that a length of the portion of the web strip between a leading end of said web strip and said predetermined position is slightly shorter than a length of a circumferential surface of the core, applying the leading end portion of the web strip to the circumferential surface of the core, applying a wrapping roller on the leading end portion of the web strip to press said leading end portion against the core, and rotating the wrapping roller along the core toward said predetermined position by a predetermined angle with the leading end portion of the web strip intervening between the core and the wrapping roller.

13. A wrapping system for wrapping a leading end portion of a web strip around a core comprising a contacting means which brings the web strip into contact with the core at a predetermined position, an applying means which applies the leading end portion of the web strip to a circumferential surface of the core and a wrapping roller which presses the leading end portion of the web strip against the core and rolls along the core toward said predetermined position by a predetermined angle with the web strip intervening between the core and the wrapping roller, a length of the leading end portion of the web strip being slightly shorter than a length of said circumferential surface of the core.

14. A wrapping system as defined in claim 13 in which said contacting means comprises a surface drum on which the core is positioned.

15. A wrapping system as defined in claim 14 in which said applying means comprises a slide roller which is movable up and down and toward and away from the core, and lifts the leading end portion of the web strip and presses the leading end portion against the core.

16. A wrapping system as defined in claim 13 in which said wrapping roller is provided with a web guide having a guide surface which is positioned close to the surface of the core when the wrapping roller is pressing the leading end portion of the web strip against the core.

17. A wrapping system as defined in claim 16 in which said guide surface of the web guide is an arcuate surface whose radius of curvature substantially conforms to a radius of curvature of the core.

18. A wrapping system as defined in claim 17 in which said web guide is tapered toward said predetermined position in cross-section.

19. A wrapping system as defined in claim 13 in which said wrapping roller comprises a plurality of divisional wrapping rollers which are arranged in a row in the direction of the width of a web from which said web strip was cut.

* * * * *